United States Patent [19]

Primdahl et al.

[11] Patent Number: 4,921,463

[45] Date of Patent: May 1, 1990

[54] COIN SORTER WITH COUNTER AND BRAKE MECHANISM

[75] Inventors: Richard D. Primdahl, Hoffman Estates; Donald E. Raterman, Deerfield, both of Ill.

[73] Assignee: Cummins-Allison Corporation, Mt. Prospect, Ill.

[21] Appl. No.: 113,869

[22] Filed: Oct. 27, 1987

[51] Int. Cl.[5] ..... G07D 3/16

[52] U.S. Cl. ..... 453/3; 453/58; 188/160

[58] Field of Search ..... 453/3, 4, 5, 6, 9, 10, 453/12, 13, 29, 30, 32, 49, 57, 58, 63; 188/156, 157, 161, 162, 163, 158, 159, 160, 180; 222/333

[56] References Cited

U.S. PATENT DOCUMENTS

| | | | |
|---|---|---|---|
| Re. 29,090 | 12/1976 | Fougere . | |
| 2,084,171 | 6/1937 | Volkers | 188/160 |
| 2,117,912 | 5/1938 | Santini | 188/163 X |
| 2,351,197 | 6/1944 | Francis | 453/10 |
| 2,835,260 | 5/1958 | Buchholz | 453/6 |
| 3,246,658 | 4/1966 | Buchholz et al. . | |
| 3,368,657 | 2/1968 | Wrensch et al. | 188/161 X |
| 3,458,022 | 7/1969 | Reiff | 188/161 X |
| 3,587,798 | 6/1971 | Schuman | 188/161 X |
| 3,861,567 | 1/1975 | Davis, Jr. | 222/333 |
| 3,984,033 | 10/1976 | Groth et al. | 222/333 |
| 3,998,237 | 12/1976 | Kressin et al. . | |
| 4,274,409 | 6/1981 | Bush | 222/333 X |
| 4,430,592 | 2/1984 | Manktelow | 188/161 X |
| 4,564,036 | 1/1986 | Ristvedt . | |
| 4,570,655 | 2/1986 | Raterman . | |

FOREIGN PATENT DOCUMENTS

| | | | |
|---|---|---|---|
| 0149906 | 7/1985 | European Pat. Off. | 453/6 |

OTHER PUBLICATIONS

Inertia Dynamics Inc., Electric Clutches & Brakes, Catalog CB485, Apr. 1986.

*Primary Examiner*—Joseph J. Rolla
*Assistant Examiner*—Edward S. Ammeen
*Attorney, Agent, or Firm*—Kareem M. Irfan

[57] ABSTRACT

A coin sorter having a rotatable disc includes a brake mechanism for stopping rotation of the disc in response to a predetermined number of counted coins. The disc is driven through a gear train by an electric motor. The brake mechanism includes an electromagnetic actuating assembly and an armature mounted on the shaft of a motor. Upon energization of the actuating assembly, the armature is drawn into contact with the actuating assembly to provide a braking pressure which halts rotation of the motor and the disc.

3 Claims, 1 Drawing Sheet

COIN SORTER WITH COUNTER AND BRAKE MECHANISM

BACKGROUND OF THE INVENTION

1. Field Of The Invention

The present invention relates generally to coin sorters of the type which use a rotatable disc having a resilient surface operating with an adjacent stationary guide plate and, more particularly, to such sorters which have a counter for counting the number of coins sorted and a brake for stopping the disc when the counter indicates that a preselected number of coins have been sorted.

2. Summary of the Invention

It is a primary object of the present invention to provide a coin sorter of the type described above which has an improved drive and brake system for stopping the rotatable disc quickly and reliably over a large number of operating cycles.

It is another important object of this invention to provide such a coin sorter having a drive and brake system which is relatively inexpensive to install and maintain.

A further object of the invention is to provide such a coin sorter having a drive and brake system which permits the use of a relatively small brake mechanism.

Other objects and advantages of the invention will become apparent from the following detailed description and the accompanying drawings.

In accordance with the present invention, the foregoing objectives are realized by providing a coin sorter having a rotatable disc with a resilient surface and a stationary guide plate positioned adjacent to the resilient surface for guiding coins on the resilient surface as the disc is rotated; counting means for counting coins of at least one denomination as the coins are processed by the sorter; an electric motor having an output shaft for driving the rotatable disc; a speed-reducing gear train connected between the output shaft of the electric motor and the rotatable disc; and braking means responsive to the counting means for stopping the rotatable disc when a preselected number of coins have been counted, the braking means being connected to the output shaft of the motor. The braking means preferably comprises an armature fixed to the output shaft of said motor and including a disc forming a flat surface to which braking pressure can be applied, and an electromagnetic actuator for applying braking pressure to the flat surface of said disc when said actuator is supplied with electrical power.

Figure 1:
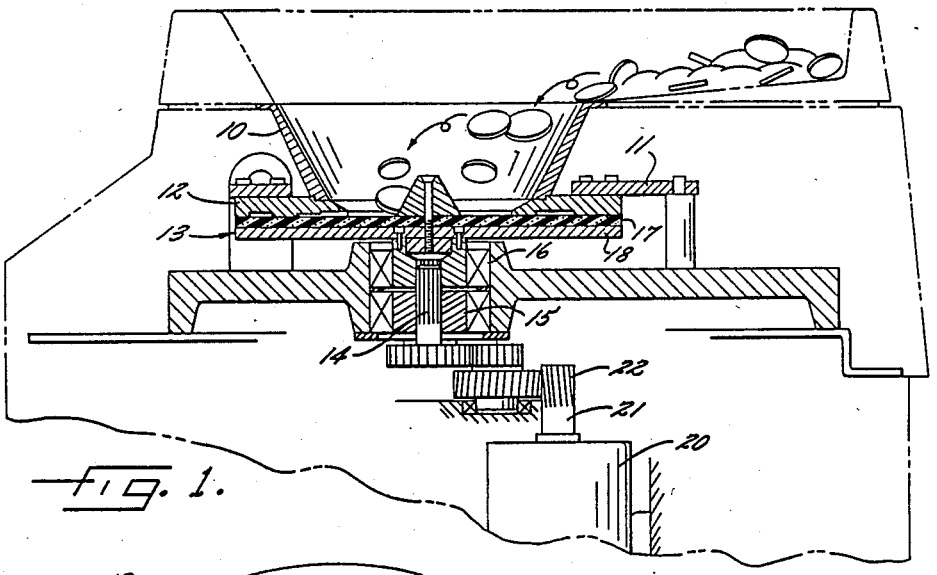
FIG. 1 is a vertical section of a coin sorter embodying the present invention.

While the invention is susceptible to various modifications and alternative forms, specific embodiments thereof have been shown by way of example in the drawings and will be described herein in detail. It should be understood, however, that it is not intended to limit the invention to the particular forms disclosed, but, on the contrary, the intention is to cover all modifications, equivalents and alternatives falling within the spirit and scope of the invention as defined by the appended claims.

DESCRIPTION OF THE PREFERRED EMBODIMENT

Turning now to the drawings, there is shown a coin sorter which includes a hopper 10 for receiving coins of mixed denominations and feeding them through central openings in a housing 11 and an annular sorting head or guide plate 12 inside the housing. The coins are deposited on the top surface of a disc 13 mounted for rotation on a splined stub shaft 14 which fits into a hub 15 affixed to the bottom of the disc. The hub 15 in turn is mounted within ball bearings 16 in the base of the housing 11.

The disc 13 comprises a resilient pad 17 bonded to the top surface of a solid metal disc 18. The top surface of the resilient pad 17 is typically covered with a durable fabric bonded to the pad itself, which is typically made of a resilient rubber material. As the disc 13 is rotated, the coins deposited on the top surface thereof tend to move outwardly over the surface of the pad due to centrifugal force. The coins which are lying flat on the pad travel outwardly beneath the guide plate 12 because the underside of this plate is spaced above the pad 17 by a distance which is slightly greater than the thickness of the thickest coin.

Figure 2:
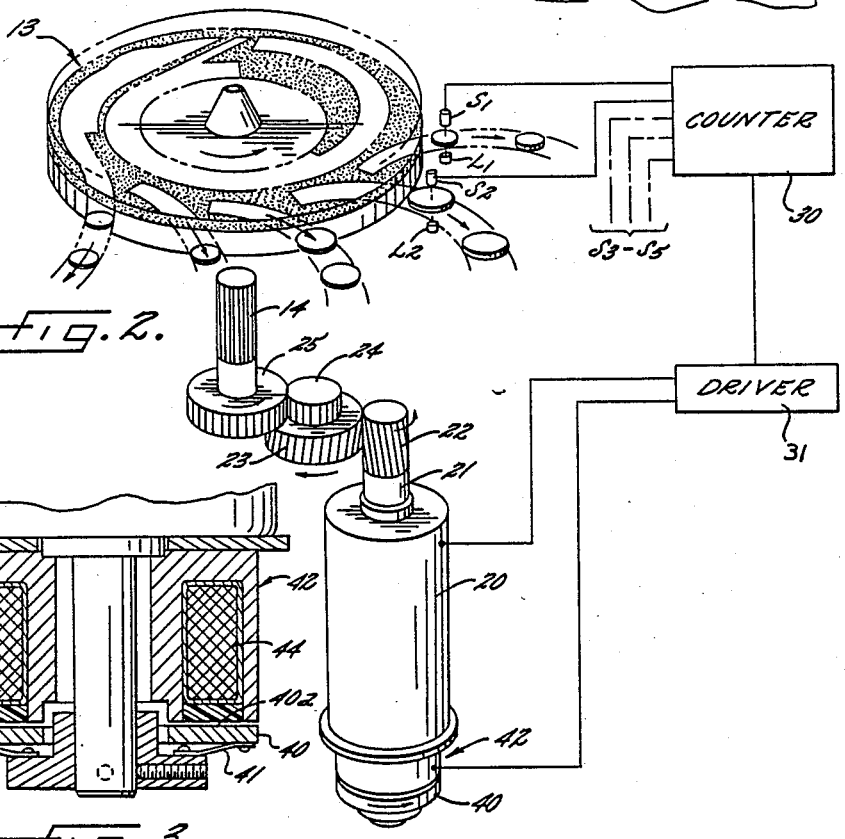
FIG. 2 is a perspective view, on a reduced scale, of the coin sorter shown in FIG. 1.

The bottom surface of the guide plate 12 is configured to sort the coins by denomination as the coins are rotated beneath the plate 12 by the disc 13. As illustrated in FIG. 2, different denominations of coins are eventually ejected at different circumferential locations around the periphery of the guide plate 12. The particular configuration of the guide plate surface which effects the sorting may be any of a variety of different designs, one example of which is described in the assignee's copending U S. patent application Ser. No. 034,271 filed Apr. 1, 1987, abandoned, which is incorporated herein by reference.

It is important that the disc 13 remain flat, without any flexing, twisting or other physical distortion, in order to prevent any mis-sorting of the coins. To provide such stability, the metal disc 18 must be made rigid and massive enough to withstand the pressure exerted thereon by the rotating coins as they are pressed down into the pad 17 by the fixed guide plate 12.

In order to drive the disc 13 at a controlled angular velocity, an electric motor 20 is connected to the disc through a speed-reducing gear train. Thus, the motor 20 has an output shaft 21 which carries a helical pinion gear 22. The pinion 22 meshes with a gear wheel 23 carrying a pinion 24 which, in turn, meshes with a gear wheel 25 on the lower end of the stub shaft 14. With this speed-reducing gear train, the disc 13 is typically driven at 200 rpm by a motor turning at 1750 rpm.

Because of the torque-multiplying effect of the gear train, the output torque of the motor 20 can be much less than the torque required to drive the disc 13. For example, with the type of gear train illustrated, an electric motor producing a starting torque of 84 inch-pounds and a running torque of 60 inch-pounds can bring a 3-pound, 11-inch diameter disc 13 up to speed within about 0.3 seconds, even when the sorter is loaded with coins.

For the purpose of counting the number of coins of each denomination discharged from the sorter, an electronic counter 30 receives signals from multiple photosensors S1–S5 located adjacent the respective coin discharge paths. These photosensors S1–S5 normally receive light from corresponding light sources L1–L5, but the light beam is interrupted each time a coin passes between one of the sources L1–L5 and the corresponding sensor S1–S5. Whenever one of the light beams is interrupted, the interruption produces a positive transition in the electrical output of the corresponding photosensor S1–S5, and this transition is detected by the counter 30. Each positive transition is treated as a separate count, and the number of counts from each sensor is accumulated until it reaches a preselected level. Typically, the preselected level represents the number of coins desired in a particular type of receptacle such as a coin bag attached to the sorter.

In accordance with one important aspect of the present invention, a brake mechanism responsive to the counter 30 is connected to the motor output shaft 21 for stopping the rotating disc 13 when a preselected number of coins have been counted. When the disc 13 is rotating, it has a moment of inertia which is a function of the mass, size and shape of the disc. The torque applied to the drive train by the rotating disc is a function of both the moment of inertia and the angular acceleration of the disc. In order to bring the rotating disc to a stop, this load torque produced by the disc must be overcome by the braking torque and the frictional resistance applied to the disc by any coins thereon and the pressure of the stationary guide plate 12 on those coins. By applying the braking force to the output shaft of the drive motor, a relatively small torque is sufficient to brake the rotating disc because the braking torque applied to the motor shaft is multiplied by the speed-reducing gear train. Thus, the disc can be quickly and reliably stopped with a relatively inexpensive brake mechanism which has a long operating life, e.g., in excess of a million operating cycles.

Figure 3:
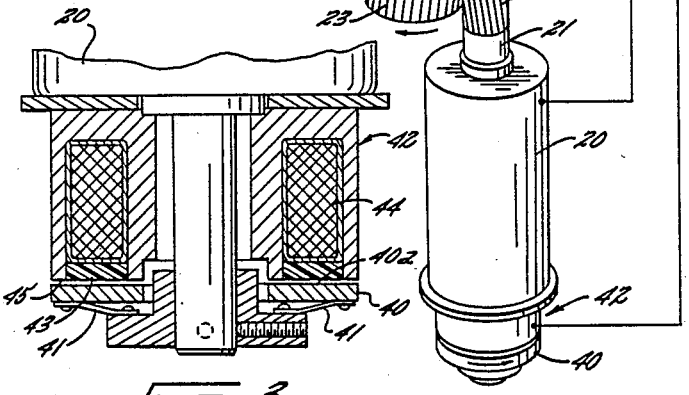
FIG. 3 is a vertical section of the brake mechanism included in the coin sorter of FIGS. 1 and 2.

The preferred brake mechanism for use in this invention is an electrically powered disc brake. Thus, in the illustrative embodiment shown in FIG. 3, an armature 40 mounted on the lower end of the motor shaft 21 forms a disc with a flat surface 40*a* to which braking pressure may be applied to stop the drive train. The armature 40 is mounted for limited axial movement relative to the shaft 21 by means of a plurality of spring elements 41. To apply braking pressure to the disc 40, a stationary electromagnetic actuator 42 is mounted directly beneath the disc 40. This actuator 42 includes a friction ring 43 for gripping the disc surface 40*a* with a minimum of slippage. The actuator also includes a coil 44 which, when energized from an electrical power source, magnetizes a stator 45 to draw the disc 40 into tight engagement with the friction ring 43. The braking torque thus applied to shaft 21 is multiplied by the speed-reducing gear train and applied to the disc 13 via the stub shaft 14.

One example of a commercially available brake mechanism of the type described above is the Type FB17 Power-On Disc Brake made by Inertia Dynamics, Inc. of Collinsville, Conn.

To control the energization of the electromagnetic brake, the output signal from the counter 30 is supplied to a driver circuit 31 which controls the electrical current fed to the coil 44. This same driver circuit 31 also controls the electrical power supplied to the electric drive motor 20. When the counter output indicates that the desired number of coins have been discharged from one of the sorter exit slots, the driver circuit 31 de-energizes the motor 20 and energizes the coil 44 so that the motor 20 is no longer driving its output shaft when the brake is applied.

The actuator coil 44 is preferably energized initially at a relatively high power level to quickly initiate the braking action, and then at a lower power level to bring the disc 13 and its drive train to a complete stop. For example, with the particular brake mechanism identified above, the driver circuit 31 preferably applies 36 volts across the coil for about 5 milliseconds, and then 12 volts for a further 25 milliseconds. With these voltage levels, the disc 13 can be brought to a complete stop in about 20 milliseconds. This braking time corresponds to an angular movement of the disc of only about 15 degrees, which is small enough to prevent the discharge of additional unwanted coins in most situations.

In accordance with a further aspect of the invention, the helical pinion gear on the output shaft of the motor 20 has teeth pitched in a direction to urge the shaft axially away from the electromagnetic actuator of the brake mechanism in response to a driving torque from the motor, so that application of a braking torque to the same shaft urges the shaft axially toward to electromagnetic actuator. Thus, in the particular embodiment illustrated in FIG. 2, the pitch of the teeth on the pinion gear 22 produces a force vector in the direction of the axis of the motor shaft 21 which biases the shaft downwardly so that the armature 40 is urged away from the stationary actuator 42 when the motor is driving the disc 13 during a sorting operation. When the motor is de-energized and the brake energized to stop the disc 13, the direction of the axial force vector is reversed so that the motor shaft 21 is biased upwardly to draw the armature 40 toward the electromagnetic actuator 42. This provides a brake boost which supplements the braking force applied by the energization of the electromagnetic actuator.

As can be seen from the foregoing detailed description, this invention provides a coin sorter with an improved drive and brake system which stops the rotatable disc of the sorting mechanism quickly and reliably over a large number of operating cycles. Equally important is the fact that the drive and brake system is relatively inexpensive to install and maintain.

I claim:

1. In a coin sorter having a rotatable disc with a resilient surface and a stationary guide plate positioned adjacent said resilient surface for guiding coins on said resilient surface as said disc is rotated, counting means for counting coins of at least one denomination as the coins are processed by said sorter, and electric motor having an output shaft for driving said rotatable disc, a speed reducing gear train connected between the output shaft of said electric motor and said rotatable disc, and a braking means responsive to said counting means for stopping said rotatable disc when a preselected number of coins have been counted, said braking means being connected to the output shaft of said motor and including a stationary electromagnetic actuating assembly and an axially movable armature mounted on said motor shaft for a movement into and out of engagement with said actuating assembly in response to energization and de-energization of said actuating assembly, and a helical pinion gear on said motor shaft for connecting said shaft to said gear train, said pinion gear having helical teeth pitched in a direction to urge said shaft axially away from said actuating assembly in response to a driving torque from said motor., so that the application of a braking torque to said shaft urges said shaft axially toward said actuating assembly.

2. In a coin sorter having a rotatable disc with a resilient surface and a stationary guide plate positioned adjacent said resilient surface for guiding coins on said resilient surface as said disc is rotated, counting means for counting coins of at least one denomination as the coins are processed by said sorter, an electric motor having an output shaft for driving said rotatable disc, a speed-reducing gear train connected between the output shaft of said electric motor and said rotatable disc, and a braking means responsive to said counting means for stopping said rotatable disc when a preselected number of coins have been counted, said braking means being connected to the output shaft of said motor and including a stationary electromagnetic actuating assembly and an axially movable armature disc mounted on said motor shaft for movement into and out of engagement with said actuating assembly in response to energization and re-energization of said actuating assembly, said electromagnetic actuating assembly having a friction ring adapted to frictionally engage said armature disc in response to energization of said electromagnetic actuating assembly, and a helical pinion gear on said motor shaft for connecting said shaft to said gear train, said pinion gear having helical teeth pitched in a direction to urge said shaft axially away from said actuating assembly in response to a driving torque from said motor, so that the application of a braking torque to said shaft urges said shaft axially toward said actuating assembly.

3. A coin sorter having a rotatable disc with a resilient surface and a stationary guide plate-positioned adjacent said resilient surface for guiding coins on said resilient surface as said disc is rotated, comprising:

counting means for counting coins of a least one denomination as the coins are processed by said sorter, an electric motor having an output shaft for driving said rotatable disc, a brake mechanism connected to the output shaft of said motor and being responsive to said counting means for stopping said rotatable disc when a predetermined number of coins have been counted, said brake mechanism including a stationary electromagnetic actuating assembly and an axially movable armature mounted on said motor shaft for movement into and out of engagement with said actuating assembly in response to energization and de-energization of said actuating assembly, and a helical pinion gear on said motor shaft for connecting said shaft to said gear train, said pinion gear having helical teeth pitched in a direction to urge said shaft axially away from said actuating assembly in response to a driving torque from said motor, so that the application of a braking torque to said shaft urges said shaft axially toward said actuating assembly, and means for initially energizing said brake mechanism at a first power level for a first predetermined period of time and energizing said brake mechanism at a second lower power level for a subsequent second period of time.

* * * * *

UNITED STATES PATENT AND TRADEMARK OFFICE

CERTIFICATE OF CORRECTION

PATENT NO. : 4,921,463

DATED : May 1, 1990

INVENTOR(S) : Primdahl et al.

It is certified that error appears in the above-identified patent and that said Letters Patent is hereby corrected as shown below:

Column 6, line 12, after "disc," the following has been added:

a speed-reducing gear train connected between the output shaft of said electric motor and said rotatable disc,

Signed and Sealed this

Twenty-eighth Day of April, 1992

*Attest:*

HARRY F. MANBECK, JR.

*Attesting Officer*

*Commissioner of Patents and Trademarks*